US005153988A

United States Patent [19]

Mattis et al.

[11] Patent Number: 5,153,988

[45] Date of Patent: Oct. 13, 1992

[54] METHOD OF MAKING MODULAR TELECOMMUNICATIONS TERMINAL BLOCK

[75] Inventors: John S. Mattis, Sunnyvale; James C. Milroy, Palo Alto; Paul von der Lippe, Granada; Gerald L. Shimirak, Danville; Paul S. Chan, San Francisco; Sebastiano Scarampi, Los Altos, all of Calif.

[73] Assignee: Raychem Corporation, Menlo Park, Calif.

[21] Appl. No.: 499,117

[22] Filed: Mar. 26, 1990

[51] Int. Cl.[5] ..... H01R 43/04

[52] U.S. Cl. ..... 29/863; 29/858; 29/861; 174/76; 174/77 R; 264/272.11; 439/5.97

[58] Field of Search ..... 29/857, 747, 861, 749, 29/863, 858; 439/597; 174/76, 77 R; 264/272.11

[56] References Cited

U.S. PATENT DOCUMENTS

| | | | |
|---|---|---|---|
| 2,700,206 | 1/1955 | Gilbert | 29/858 |
| 3,141,054 | 7/1964 | Francis | 439/597 X |
| 3,668,779 | 6/1972 | Turner | 264/272.11 X |
| 4,759,723 | 7/1988 | Siemon . | |
| 4,824,390 | 4/1989 | Crane et al. . | |
| 4,863,535 | 9/1989 | More | 174/76 X |
| 5,085,597 | 2/1992 | Story et al. . | |

FOREIGN PATENT DOCUMENTS 2622058 8/1989 France .

OTHER PUBLICATIONS

Reichle De-Massari Catalogue (dated Sep., 1989?).
Telcor, Inc. Advertisement (1989).
Homaco, Inc. Advertisement (date uncertain).
Panduit Electrical Group Advertisement (EC&M, Jan., 1990).
Abstract of Paper by Erwin De Bruycker et al. in Proc of Intr Wire & Cable Symposium (38th) Conf held Nov. 14-16, 1989, publ by NTIS, pp. 513-517, title is Environmentally Sealed Terminal Block with Rotary Connection.

*Primary Examiner*—Carl J. Arbes
*Attorney, Agent, or Firm*—Herbert G. Burkard; William D. Zahrt, II; A. Stephen Zavell

[57] ABSTRACT

The invention provides for a modularized terminal block and an improved method of manufacturing the modular block. The block permits the connection of a plurality of drop wires or other devices in a reversible manner through the use of a standardized plug in module configuration. The module can be optimized for a given drop wire range which then uniformly uniformly connects to the base block through a standardized demateable contact.

8 Claims, 13 Drawing Sheets

METHOD OF MAKING MODULAR TELECOMMUNICATIONS TERMINAL BLOCK

FIELD OF THE INVENTION

This invention relates to telecommunications terminal blocks. More specifically, this invention relates to an environmentally sealed telecommunication terminal block with a standardized mateable/demateable interface module(s) optimized to fit a plurality of different drop wire sizes or add-on features to be wired into the trunk and local loop systems.

BACKGROUND OF THE INVENTION

Terminals come in a wide variety of configurations for different environments. Telecommunications terminals were optimized for use with copper drop wires. Through an evolutionary process, a plurality of different wire sizes and kinds of wire are employed to connect the subscriber to the phone company. The gauges can vary from 12–30 AWG gauge copper based wires some of which may have steel cores. Most common wire sizes are between 16–26 gauge. Standard conventional terminals have a threaded binding post embedded in a suitable dielectric base material. The drop wire is stripped of its insulation, formed in a "C" shape, and connected to the terminal post by nuts and washers. This procedure is craft sensitive and time consuming. These terminals, while extremely low cost, suffer high maintenance and repair costs due to corrosion, e.g., oxidation on the exposed wires and binding posts. In addition, wet/humid weather, or periodic water submersion, or salt/fog corrosion, or dew on insect nests can cause cross talk or signal loss. A serviceman is dispatched in response to a customer complaint only to find that the problem has disappeared due to the evaporation of the moisture.

Insulation displacement terminals, which cut through the wire insulation without requiring wire stripping, address the time consuming installation problems. However, many of these terminals also suffer from corrosion, often more severe than standard binding post and washer/nut terminals. In addition, overnotching of the conductor may sever or severely weaken the drop wire rendering it subject to premature failure. The premature failure of the drop wires significantly increases the telephone company's repair costs. In addition, initial use of the terminal on a large drop wire may damage the terminal and preclude its subsequent use on smaller drop wires.

U.S. application Ser. Nos. 07/462,173 filed Jan. 8, 1990, now U.S. Pat. No. 5,069,636 07/231,755 filed Aug. 13, 1988, now abandoned, and U.S. Pat. No. 4,846,721 solved many of these problems with a uniquely formed electrical connection and sealing system utilizing a reenterable gel material. The gel sealing system utilized in the terminals are, inter alia, disclosed in U.S. Pat. Nos. 4,865,905; 4,864,725; 4,600,261; 4,634,207; 4,643,924; and 4,690,831. However, these blocks were only readily adaptable to wires, e.g., drop wires. These preceding specifications and patents are completely incorporated herein by reference for all purposes.

Although these terminals can form electrical contacts to a plurality of different wire sizes, an even easier, more versatile system would be desirable. In addition, with an increasing use of computers, and the overcrowding of conventional telephone lines limiting the capacity of the copper plant system architecture, a terminal which can be subsequently adapted after installation, to include circuit protection, filters, cable TV, optical fibers, and/or digitizing of the telephone signal, e.g., digital added main lines, (DAML), to increase the number of different phone numbers available through each twisted pair of wires, would be highly desirable.

It would also be desirable to have a modular drop wire unit which is simple for the craftsperson to install and keyed to the block to avoid misinsertions. It would additionally be desirable to have a unit which can adequately seal in a reversible fashion between the drop wire module and the block itself for subsequent additions to the block such as circuit protection, and the like.

The inability to provide a secure weatherproof system, less subject to outside plant failures, has forced the use of many add-on features, such as fused circuit protection and DAML, at the customer's protected base location. This renders them subject to tampering. The weatherproof system could be centrally located underground, on a telephone pole, or in a centrally located outside enclosure, e.g., a pedestal enclosure. As the system is upgraded, the new features can be plugged into the terminal through the common plug connection.

By a weatherproof system, we mean a modular system that meets the requirements of a present day standard outside nut and washer or insulation displacement terminal that can operate for prolonged periods in the outside plant environment. The block of the invention alone without connections or a block in combination with modules is capable of exhibiting resistance to the elements even after repeated connections/disconnections during its lifetime. At least five connections/disconnections and most likely ten or more can be expected during a terminal's lifetime. Suitable tests are ISO 846 (ASTM G-21) (1985) for fungi and bacteria. The dielectric strength of the electrical insulation in the block must be capable of passing IEC 243 (ASTM D-149) (1981). The block must also must be able to withstand corrosive effects of materials and the effects of liquid chemicals meeting the requirements of ASTM D-2671 (1985) and ISO 175 (ASTM D-543) (1987). While in use, the contact resistance cannot vary greater than the parameters permitted by ASTM B 539-80 (1985 revised) as well as withstanding salt fog testing according to ASTM B-117 (1985). Finally, to be effective the block must be able to operate while exposed to sunlight and water while remaining able to meet the standards of ASTM G-53-84 (1988) and ASTM D-257 (1983).

Thus, it would be highly desirable to have a weatherproof modular system capable of providing repeated reentry of the plug for the drop wire, fuse, digitally added mainline (DAML) apparatus, and the like, without subjecting the terminal to either corrosion or electrical failure.

The process of making the terminals is labor intensive and time consuming. The process requires the individual termination of the copper wires within the cable to the back of the terminal and thereafter potting. An embodiment of the present invention provides for the cable wires to be attached to the terminal posts without precutting. In the prior art, if the wires are cut to an improper length either a splice or a total rewiring of the terminal block was usually required. To provide a lower cost terminal and a more reliable and less labor intensive manufacturing process, it would be highly desirable to have a block which can be tested during the wiring process and prior to wire cutting and assembly.

SUMMARY OF THE INVENTION

The invention provides a solution to the previously recited needs, as well as providing desirable features and many other benefits which will become obvious to the ordinary skilled designer. More specifically, the invention provides for a sealed terminal block and a modularized method of connecting to the drop wires or other devices to permit expansion of the whole unit with the addition of other beneficial features such as circuit protection, and the like. The wire connection module, while permanently connecting to the drop wire, can be repeatedly connected and disconnected to the terminal block without corrosion problems, loss of telephone signal, or loss of weatherproofness during and between several reconnections. The modules can be optimized for specific large or small size of drop wires, e.g., 16 or 30 gauge, which is beyond present interior modular terminals. The invention also provides for a method of manufacturing the block which permits testing of all of the connections to the terminal connections prior to cutting of the individual wires and assembly of terminal block.

DETAILED DESCRIPTION OF THE INVENTION

Figure 1:
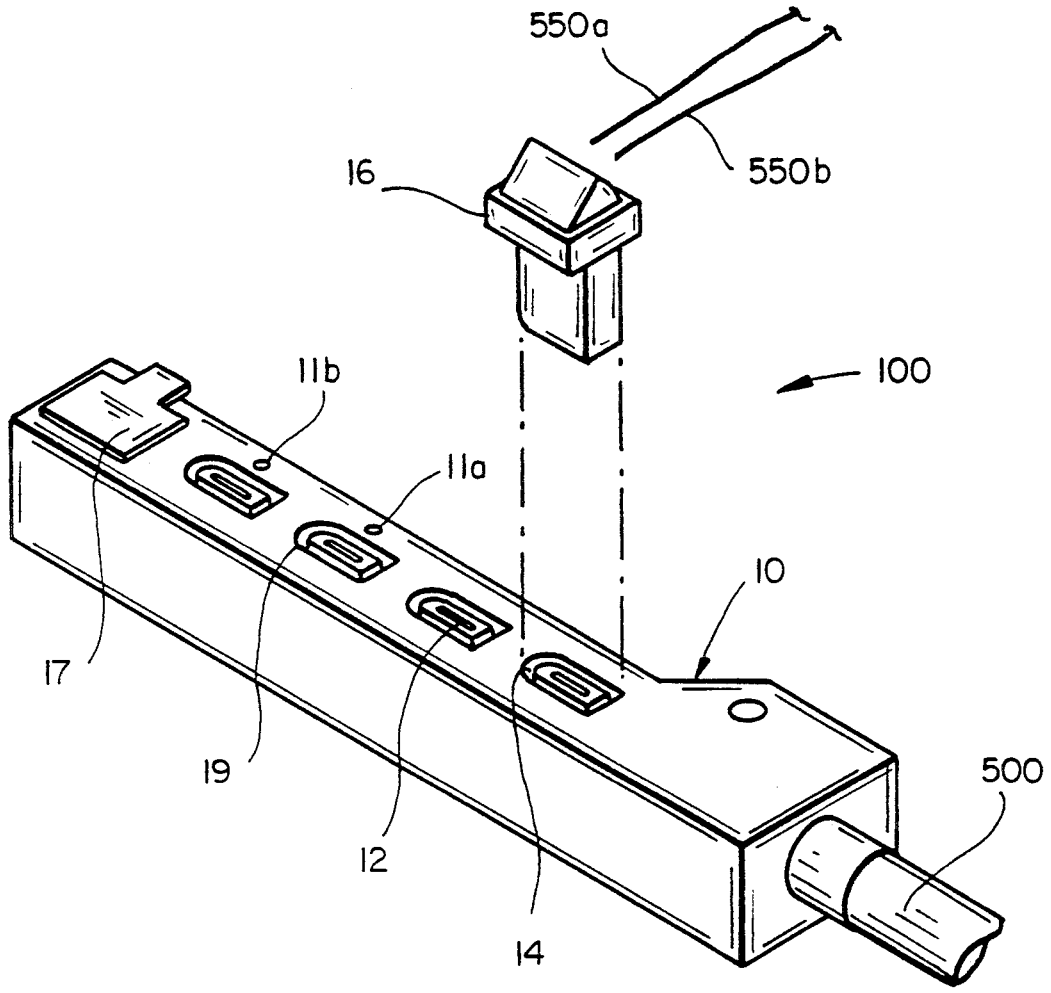
FIG. 1 illustrates a modular block embodiment of the invention.

The invention will be more clearly illustrated by referring to the specific embodiments in the appended figures. However, prior to providing more detailed descriptions of the preferred embodiments of the invention, reviewing the unexpected realizations of the inventors will highlight the uniqueness of the invention. U.S. Pat. Nos. 4,865,905; 4,864,725; 4,600,261; 4,634,207; 4,643,924; 4,690,831, the disclosures of which are completely incorporated herein by reference for all purposes, described the use of gels for sealing electrical contacts. This concept was then embodied in a terminal block as described in U.S. application Ser. or Pat. Nos. 07/231,755 filed Aug. 12, 1988 (now abandoned), U.S. Pat. No. 4,846,721, and U.S. Ser. No. 07/164,261 filed Mar. 4, 1988 (now abandoned), the disclosures of which are completely incorporated herein by reference for all purposes. Reinsertability of the drop wire into the terminal block while providing weatherproofness was a substantial advantage to the user.

In reviewing the properties of gels and the benefits gels provide, it unexpectedly dawned on the inventors that modular systems heretofore utilized only in dry protected environments such as houses or central telephone switching stations can now be removed from those environments and placed more conveniently outside. Outside locations away from the customer are less subject to tampering. This outside modular terminal/-plug system provides for easier system improvements.

It is not uncommon for buried splices or pedestal terminals to be completely immersed in water or subjected to harsh elements in the telephone closure where drop wires are connected into the main telephone system. The reenterability of gels in sealing applications has permitted us to design a modular block wherein the drop wire module can be sized specifically for permanent connections to the drop wires while having a common module-to-block electrical connection. This common block-to-module electrical interface permits a simple block to be modified to provide either direct telephone service with standard twisted pair wires or through coaxial cables, or DAML services when there are insufficient copper pairs available in the system. Coaxial cables provide the flexibility to provide video or other broadband services in the future. Protection modules for the drop wires in areas of lighting or other electrical discharges or surges can be added through the common interface to protect the subscriber and the equipment. This is all possible because the module/-block electrical interface is a standardized electrical connection system.

In the preferred embodiments, the block alone or the block in combination with the modules electrically connected thereto is capable of being stored and used at temperatures between about −40° and about 140° F., (−40° C. and 60° C.), without deterioration of product performance. The block itself, both before and after its use in conjuction with the modules, is installable in temperatures at least ranging from −14° to 113° F., (−10° C. to about +45° C.). Installation without the use of specialized tools or equipment not normally at the craftperson's disposal is a preferred feature. The block and modules can be installed with only a minimum level of training and skill.

The modularity of the block permits subsequent reworking and adding of features by even unskilled craftspeople. The unique sealing system makes the block weatherproof before use, during use, and reusable and reenterable with a plurality of add-on features when necessary without loss of weatherproofness. The modules, which fit into the block, are designed so as to accommodate unstripped drop wires of varying sizes or optimized for a specific wire such as copper clad steel. The use of the modular system permits the terminal block to be disconnected at the customer's line without removing the drop wire merely by partially removing the mateable/demateable connection between the module and the block. The block incorporates a design that optionally allows the insertion of test probes at each terminal connection in the block because the outer dielectric material is free from any current carrying components.

When the terminal block is mounted on a ground plate, the insulation between all conductors and the ground plate can withstand a lightening strike or power line across the phone lines as simulated by a minimum potential of 5K volts DC for three seconds, and the insulation between each drop wire conductor and all other conductors can withstand a minimum potential of about 3K volts DC for three seconds or other suitable test. Contact resistance within the module when measured from a two-inch length drop wire to the tail meets or is less than a 5 milliohm increase in accordance with the four-wire test method per ASTM D-539-80. The block easily passes an environmental test chamber subject to 50 cycles of −40° to +140° F., (−40° C. to 60° C.), with periodic measurements made on the tip and ring group with an applied voltage of 100 volts DC, i.e., the standard 48 volts DC is temporarily changed during the measurement process.

Although the drop wire to module connection is preferably a permanent connection, the module to block can be entered substantially more than five times, preferably more than ten times and most preferably more than fifty times without loss of the weatherproofness of the block. More specifically, the block module combination can be plugged and unplugged substantially more than five times without a change in contact resistance of greater than 2 milliohms. The block is designed to be weatherproof with or without the module inserted in the terminal block. Optionally, the modules themselves can be sealed when not in use as illustrated in the subsequent figures.

The block itself and the block connected to modules can withstand salt and water as exemplified by a submersion test in 70° F. water/5% salt solution to a depth of at least 1 foot for a period of 15 days without loss in operating characteristics. During the immersion, a minimum 10 inches of intact sheath appears above the surface of the water for each cable. No visible degradation occurs to the block or the block module combination when exposed to a salt fog in accordance with ASTM B-117 for 30 days. Constant temperature cycling at +40° to +140° F., (+40° C. to 60° C.), and 95% relative humidity for 30 days fails to produce a greater than 5 milliohm resistance increase. The drop wire to module and module to module combinations are designed so as not to exhibit a pullout under normal operating conditions as approximated by appropriate tests. This is achieved with a locking mechanism such as a latch but the electrical connection can also be configured to directly resist the normal operating pull-out forces. Of course combinations of retaining means and electrical connections can be used to resist pull-out. In preferred embodiments, the block passes standard vibration tests with an increase in contact resistance of preferably less than 2 milliohms.

Thus, in the preferred embodiments of the invention, the modular block alone, or when connected to a module, is weatherproof as defined by the majority, if not all, of the preceding weather related tests for use in harsh outside or buried environments which, prior to our design, was not available. This design removes a severe limitation on the options of the telecommunications architecture.

Although numerous optional features are described as alternative embodiments, the nature of the module/-block interface permits numerous features obvious to the ordinary skilled artisan or those that may be invented in the future to be grafted onto the plug module section such that it can be plugged into the block portion permitting expansion of the unit as the technology advances in the future.

Figure 4:
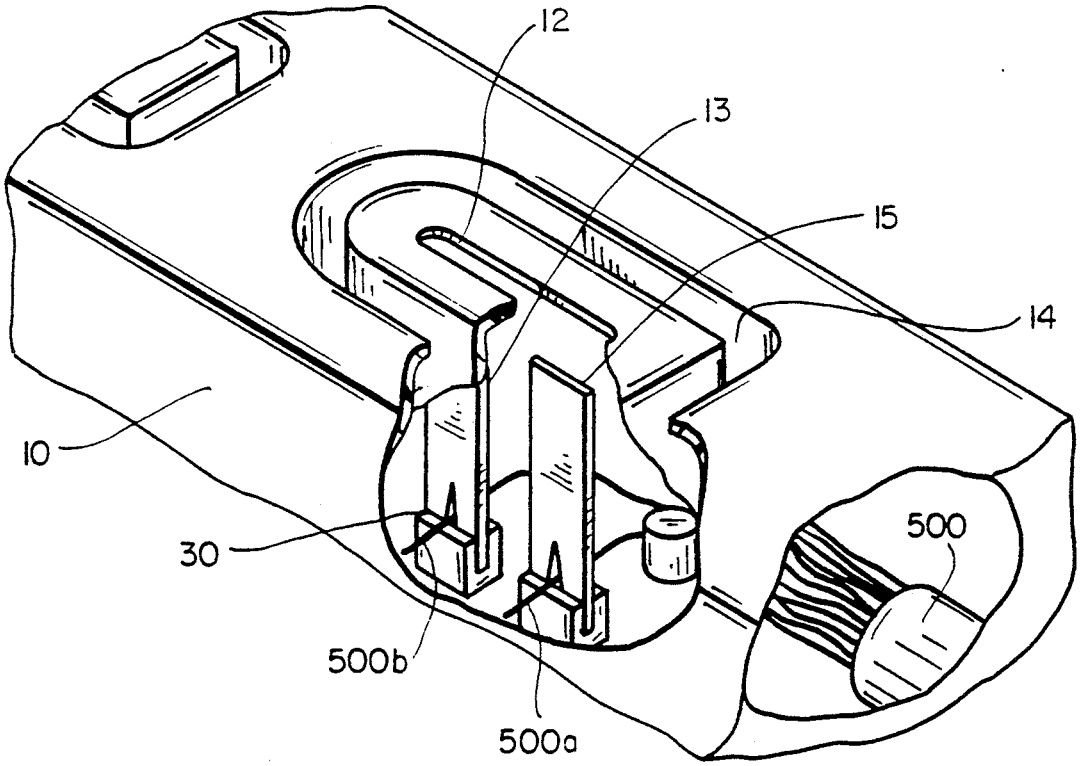
FIG. 4 illustrates a cross-sectional view of the block portion of the invention.

An embodiment of the invention is illustrated in FIG. 1 where a block module unit 100 is connected to a central office cable 500. More specifically the block 10 includes a central portion 12 in which an electrical contact 15 (FIG. 4) is encased in gel 13 (FIG. 4). The block 10 is preferably fabricated from a dielectric material, e.g., plastic. The electrical contact can reversibly mate with an electrical contact 24 (FIG. 2*b*) contained in and optionally surrounded by a gel in the module 16. A beneficial feature of the design is the protection of the electrical contacts 15/24 from shorting against other objects or its opposite poled contact member. The block 10 includes an aperture space 14 to permit the insertion of a module 16. The space 14 around the central portion 12 can have any shape that provides sufficient space for the insertion of the module 16. Generally the shape will have the central portion 12 substantially concentric within its periphery, i.e., a central square surrounded by a square space, a central tube surrounded by a cylinder, and the like. A rectangle within a rectangle or an oval within an oval is also suitable. Provided there is clearance, mixtures of shape are possible, for example a square or rectangular central portion within a cylinder or oval space, as well as combinations and mixtures thereof. If the electrical contact does not need complete protection by the module then the space 14 can have a "U" shape, and the like. The module 16 can optionally be sealed about its outer periphery with an "o"-ring 19 any other suitable sealing means for sealing the aperture from the ingress of water when not connected to a module 16. Prior to the first insertion of a module 16 or between insertions of the module 16, the aperture 12 is fitted with a cover 17 of a suitable insulating material such as plastic. A test port 11*a/b* is also provided and sealed with gel for testing the phone connection.

Figure 8:
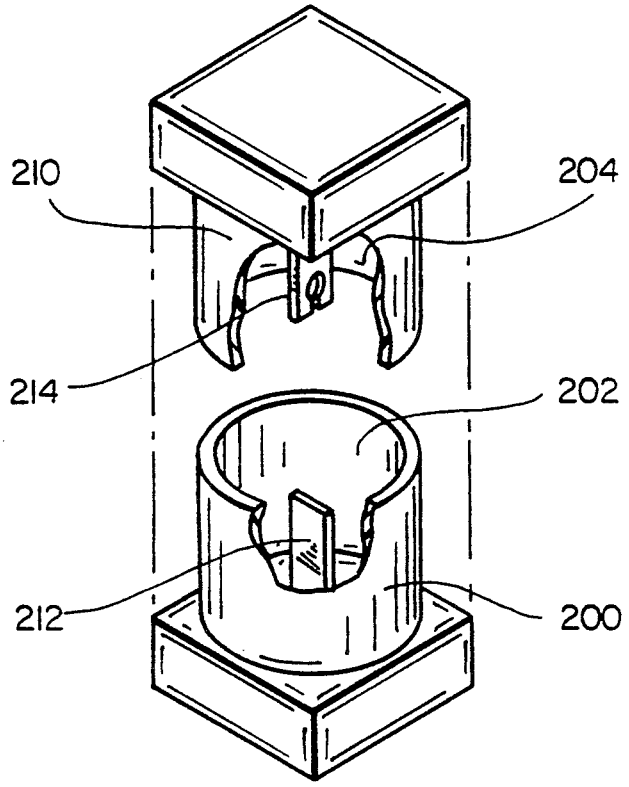
FIG. 8 illustrates an embodiment of the termination of the front insertion module for the block.
Figure 9:
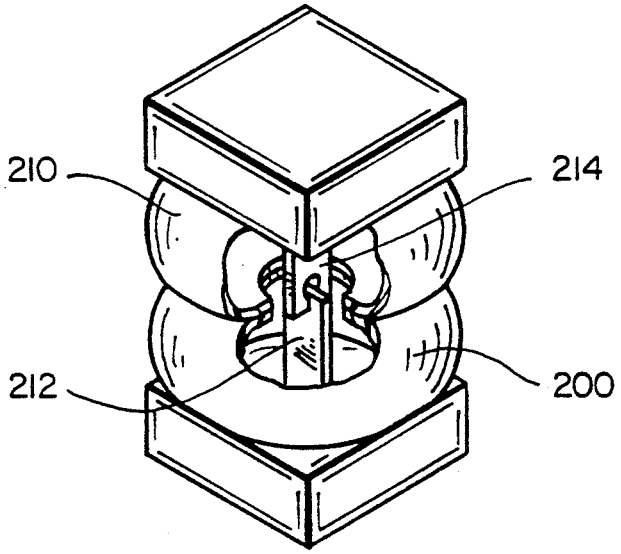
FIG. 9 illustrates the module inserted into the block.

The central portion 12 can have any shape that accepts the gel sealed electrical contacts. Suitable shapes are oval, rectangular, square, triangular, polygonal, circular, and the like. The walls of the central portion are of a dielectric material such as plastic. Of course, the material can be conductive if extra grounding is beneficial, i.e., the walls forming the central portion can optionally function as a neutral. In a preferred embodiment, the central portion is flexible, as illustrated in FIGS. 8 and 9. A twisted pair of drop wires 550 is terminated and sealed in the drop wire module 16. Suitable terminations 22' (FIG. 2*d*) for the drop wires include insulation displacement, as illustrated in FIG. 2*d*, and, less preferably, nut and washer terminations, and the like.

Figure 1A:
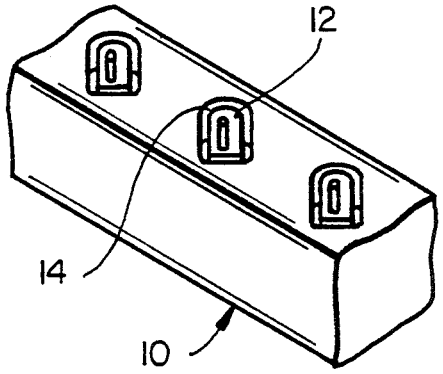
FIG. 1*a* illustrates a modular block embodiment with the receptacles canted.

The module 16 is sized to fit within the space 14. The module is keyed for only a specific insertion to avoid the crossing of the tip and ring or + and − for a standard electrical connection. Although the block and module are designed for + and −, any number of contacts can be within the module 16 or central portion 12, e.g., plus, minus, and neutral or several pairs of positive and negative combinations, and the like. Although a "D" shape is illustrated, any specific shape, e.g., "B", "U", and "Δ" can be employed. A further option provides for a plurality of paired openings in the module 16 to connect a plurality of tip and ring pairs. A still further option is canting the central contact units 12, as illustrated in FIG. 1*a*. Although 45° is preferred, as illustrated, the canting can vary from 0° to 90°. Since the drop wire module optionally also contains a gel, the demateable electrical contacts 15/24 within the terminal block 10 and module 16 are constantly protected from the elements and the contacts in the module are optionally also constantly protected.

Figure 2A:
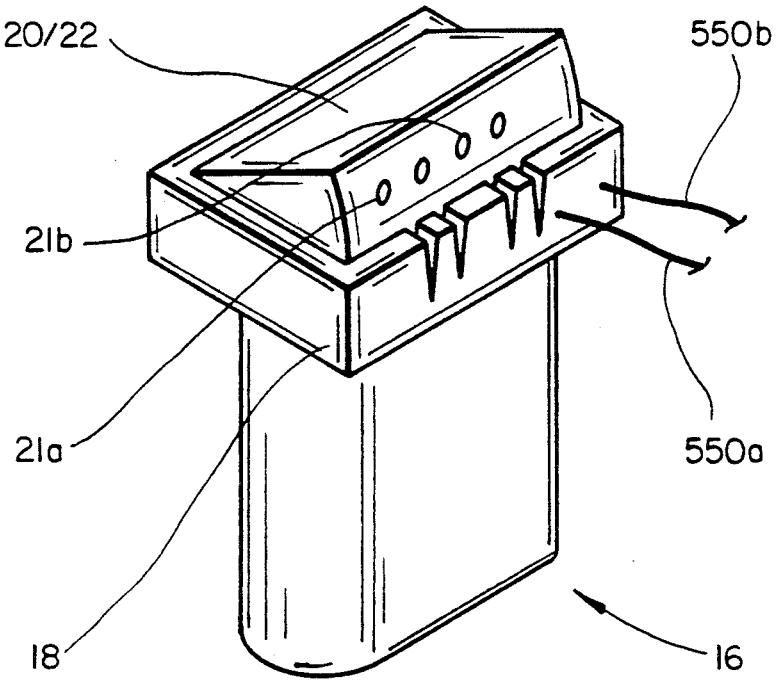
FIGS. 2*a*, 2*b*, 2*c*, and 2*d* illustrates module drop wire embodiments of the modular block system.
Figure 2B:
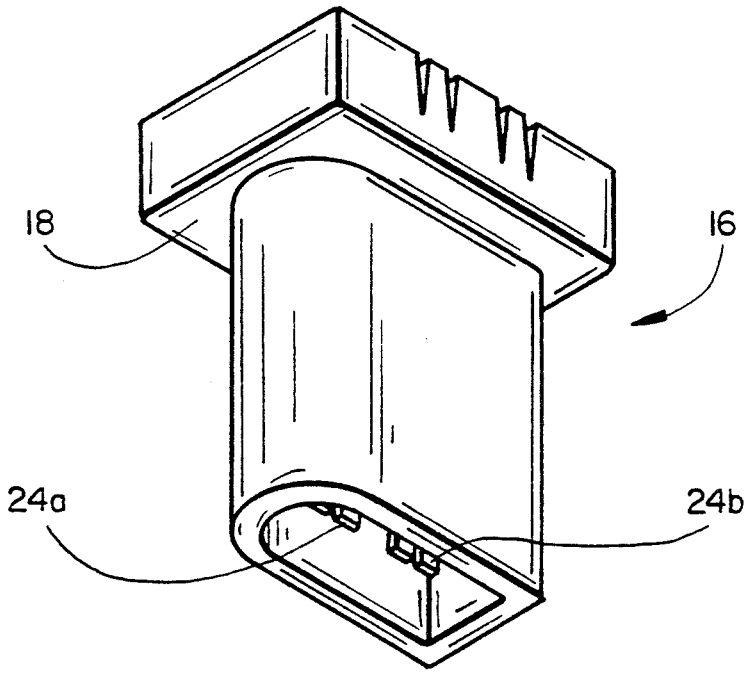
Figure 2C:
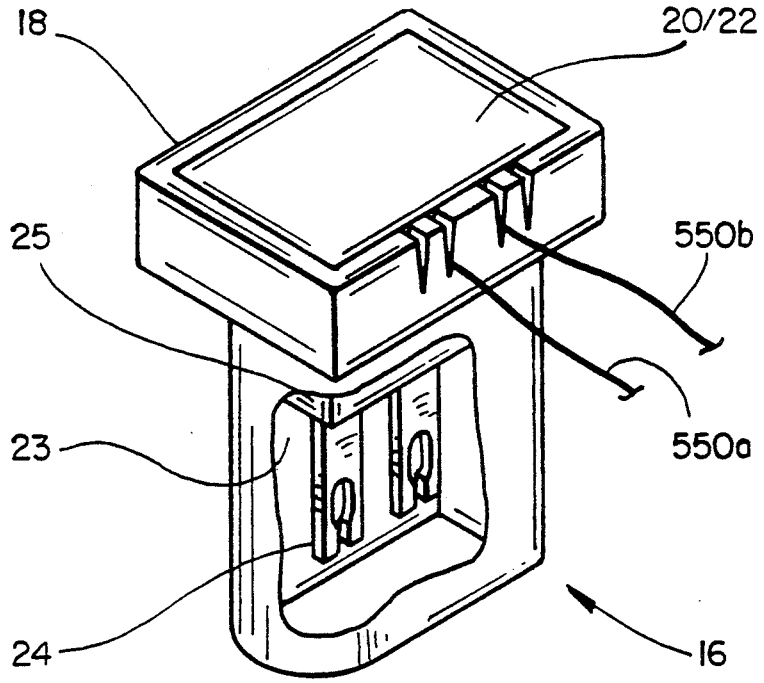
Figure 2D:
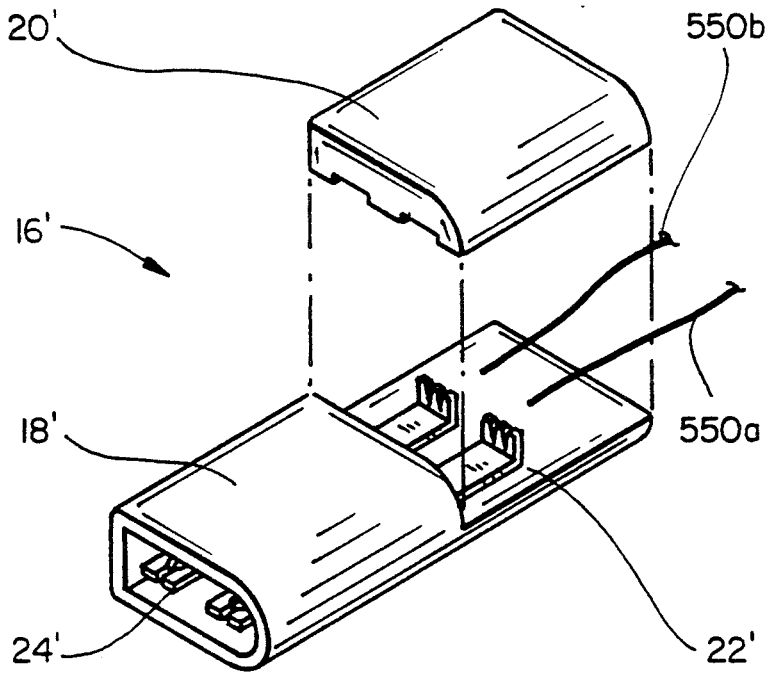

FIGS. 2*a*, 2*b*, and 2*c* illustrate the module illustrated in FIG. 1. The module 16 has a body 18 with electrical contacts 24*a* and 24*b*. A third contact, not illustrated, is required to provide neutral, if necessary. Optionally, a plurality of pairs of paired contacts can be within a module. Within the opening receptacle which includes the electrical contacts 24 is a raised base member 25. The gel 13 within the block (see FIG. 4) is of a sufficient level to meet and contact base member 25 in the event that the module does not contain gel. Thus, the module central portion is jointly configured to maintain the gel under constant positive compression to avoid the ingress of moisture. Suitable gels are silicones, ureas, urethanes, kratons, and the like. More specifically, the preferred gels are poly organo siloxanes, poly urethanes, poly ureas, styrene-butadiene and/or styrene-isoprene block copolymers, e.g., kratons, and combinations, and mixtures thereof. Suitable gels have a Voland hardness of from about 525 g (hard gel) to about 5 g (soft gel) and preferably about 450 g–380 g to about 10 g with an ultimate elongation of greater than 75% and preferably 100% or greater.

If the central portion 12 and module 16 are fabricated from rigid plastics then preferably the central portion is filled with gel and the module 16 contains no gel or only a sufficient amount to form a seal and compression means for the gel in the central portion. Optionally, the central portion 12 and module 16 can contain expansion apertures as described in U.S. Pat. No. 4,846,721. Preferably, these expansion apertures are preferably blind, i.e., closed to the outside environment. With expansion apertures, the module 16 can be completely filled with gel. In a preferred embodiment, the opening containing the electrical contacts 24 will also be filled with gel 23 to facilitate the exclusion of moisture.

The drop wires 550*a/b* are inserted into the apertures 21*a*/21*b* within the connection portion 20 of the module which holds insulation displacement contacts 22 (not illustrated in FIG. 2*a*, but see FIG. 2*d*). The openings, i.e., apertures, 21 are sized to accept the drop wire 550. Although the module 16 can be sized to accept a plurality of gauge sizes, it is preferred if the openings 21 and the module mating contact area 20/22 are optimized for a particular drop wire size. Optionally, the module can accept, as illustrated, a second or a plurality of drop wire pairs in the module. The extra pairs are often referred to as half taps, bridging taps or party line connections. A benefit of the invention is the ability to connect the drop wires into the module away from the enclosure, where there is more room and light with the subsequent connection to the block mounted in the enclosure.

An alternative drop wire module is illustrated in an embodiment in FIG. 2*d*. The module 16' contains a body 18' with insulation displacement contacts 22' and a cover 20'*a*. The drop wires 550 are placed within the insulation displacement terminals and the cover 20'*a* is snapped or crimped or screwed thereon to create the termination. The cover 20'*a* contains a suitable sealing material such as a gel to effectively seal the drop wires 550. The module 16' illustrates the contacts 24' which mate within the receptacle 12 within FIG. 1.

Figure 3:
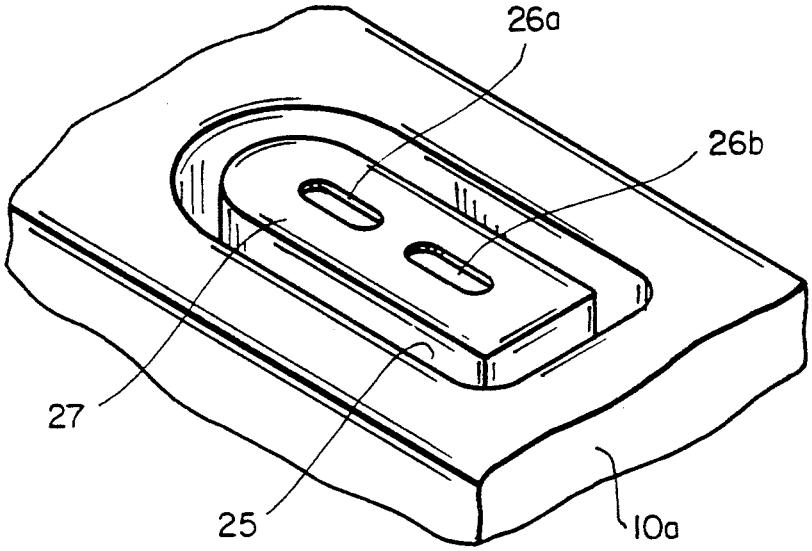
FIG. 3 illustrates an alternative embodiment of the block portion of the invention.

FIG. 3 illustrates an alternative embodiment of the block 10*a* with the area 25 for receiving the module 16 with individual ports 26*a* and 26*b* for the contacts 24*a/b* to mate with the block contacts 15, not illustrated. The top portion 27 of this central portion of the block can be covered, as illustrated, or completely open but containing gel around the electrical contacts. Complete filling with gel provides reenterable sealing whereas a mere gel membrane will not adequately reseal to provide for multiple insertions and withdrawals of the module while maintaining the blocks weatherproof seal. The cover portion 27 can be of any suitable material such as plastic and can have one or a plurality of apertures to receive the electrical contacts in the module.

FIG. 4 is a partial cross-sectional view of a portion of the block 10 illustrating the channels 14 into which the module 16 is inserted. The contact 24 can mateably connect and disconnect to the contact 15 which is surrounded by gel 13. FIG. 4 further illustrates the backside of the block 10 where the individual wires 500*a*, 500*b*, etc., within the cable 500 are terminated to the opposite end of the contacts 15 which connect to the module contact 24. However, the cable 500 side of the contact is preferably embedded in a potting material or molded into the block. Molding is preferred because it precludes water from one side of the block migrating to the other side. This will be amplified in greater detail hereafter.

The filling of the central portion 12 with gel 13 around the contacts, i.e., complete encapsulation, provides superior weatherproofing to merely a membrane of gel over the top of the block. A membrane never fully recovers to provide adequate sealing after several connections and disconnections of the module. In addition, a membrane inhibits the removal of entrapped moisture whereas encapsulation occupies all the potential volume within the central portion that might collect moisture. The central portion 12 and the module 16, with or without gel in the module, cooperate together to constantly maintain the gel under compression to inhibit the ingress of moisture or preferably to exclude moisture, i.e., the combined volume of the module and center portion is less than the center portion alone to maintain the gel under compression. When gel is contained in the module the sealing is enhanced because the module contacts are protected and the gel-to-gel interface provides even greater compression to preclude moisture. Of course when two gels are used, the selection is preferably made to avoid either gel from substantially remaining in contact with the other gel upon removal of the module. Skinning of the gel surface with powder or additional curing is an option to avoid either gel sticking to its opposite gel member.

Figure 5:
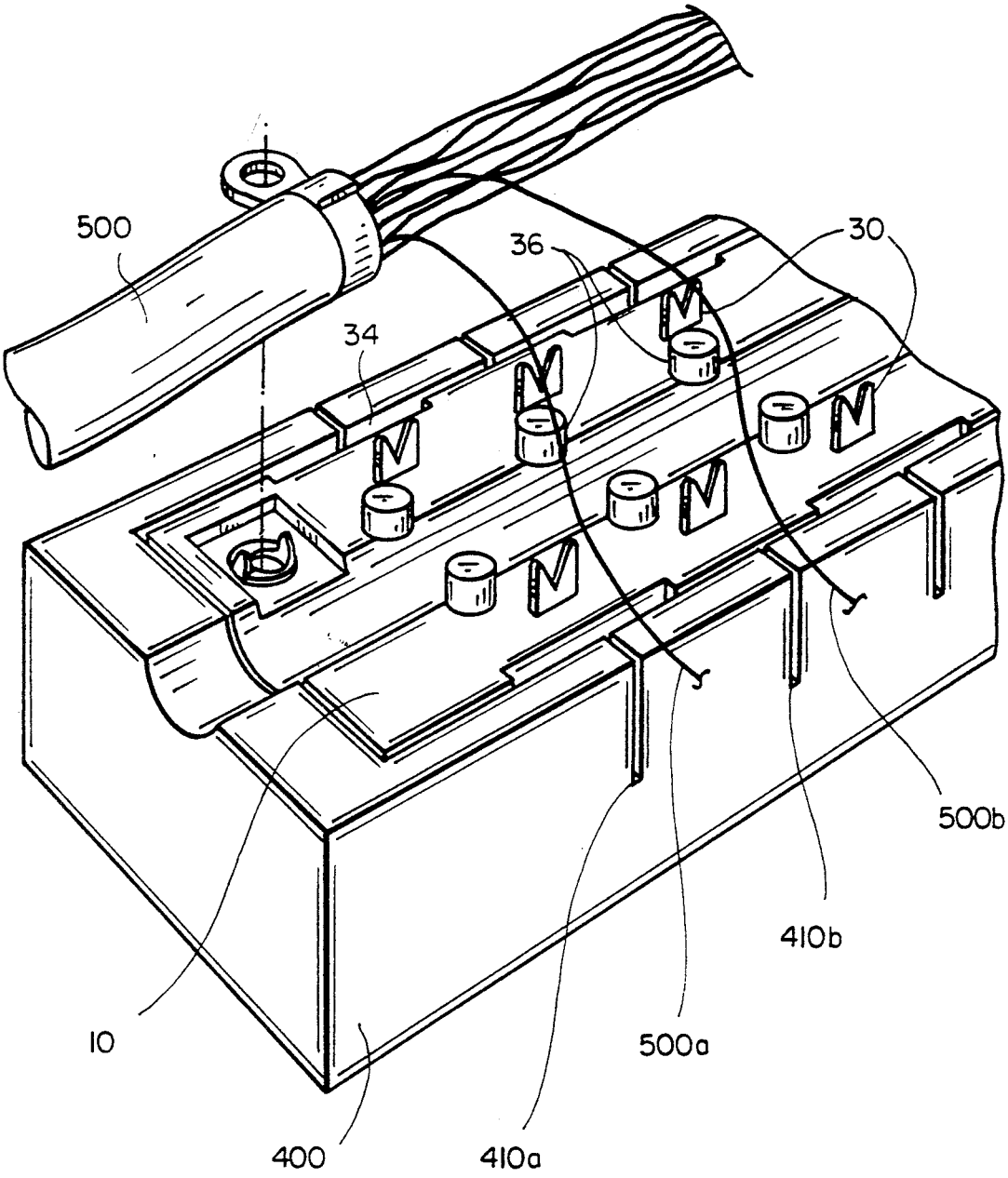
FIG. 5 illustrates the backside of the block of the invention.

FIG. 5 illustrates a preferred backside of the terminal block 10 with the cable 500 having individual wires 500*a*, etc., therein. The backside of the block 10 contains the opposite side of the electrical contacts 15 (FIG. 4), which demateably contacts the contact 24. The opposite side of the contact is illustrated as 30*a*, 30*b*, etc., in FIG. 5. An advantage of the present invention is that the cable 500 no longer requires the individual wires 500*a*, etc., separated therefrom and cut to size to be wire wrapped to the terminal contact block, as was the case heretofore. In the event that the wrong wires were cut to size, there either had to be time consuming splices or the procedure had to be started all over again. A beneficial aspect of this invention is that the cable can be terminated in a much more facile manner by referring to FIGS. 5, 6, and 7. Of course, standard wire wrapping can also be used to form the electrical contact.

Figure 6:
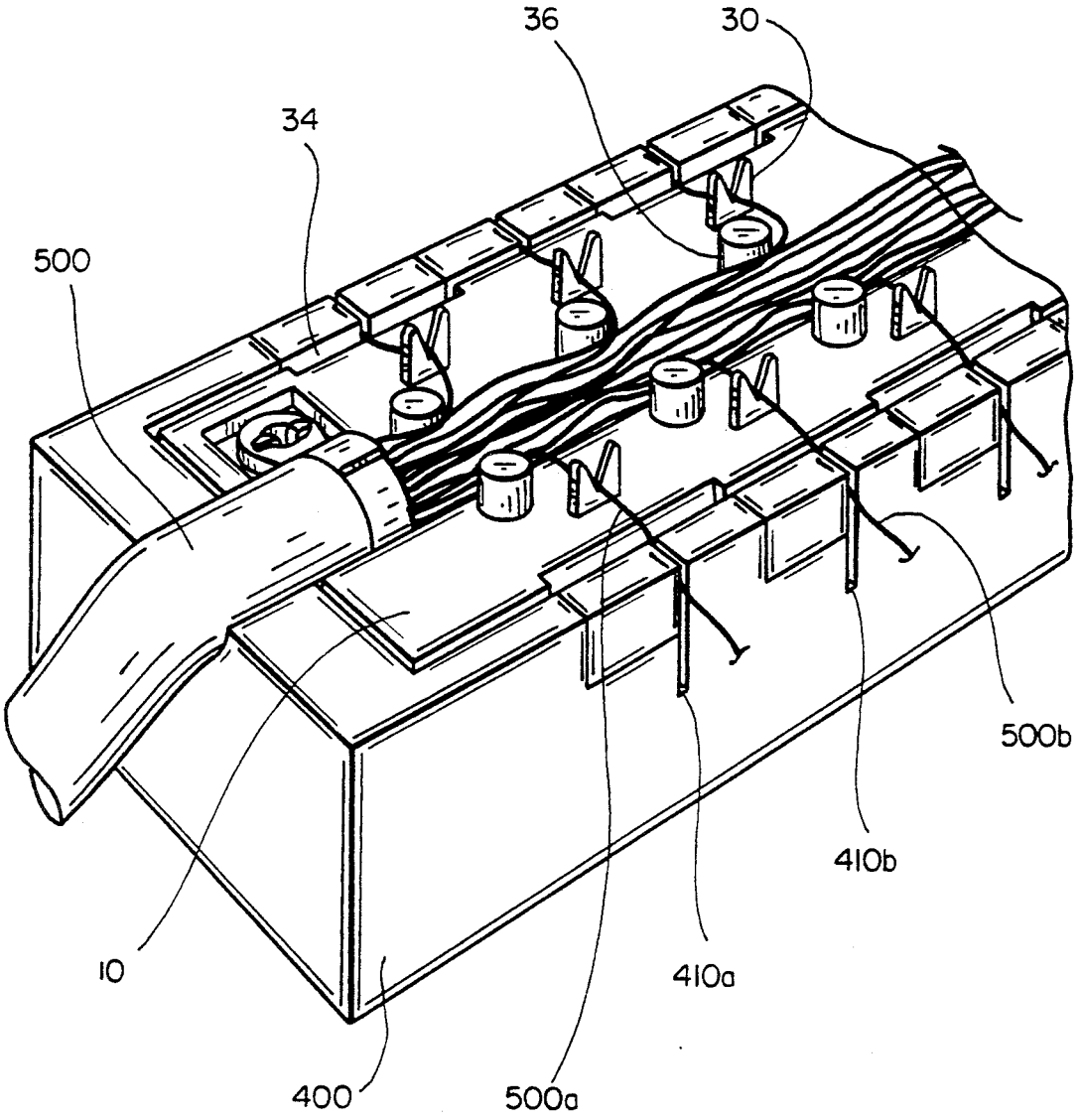
FIG. 6 illustrates the back side of the block with the individual wires within the cable connected to the terminals.
Figure 7:
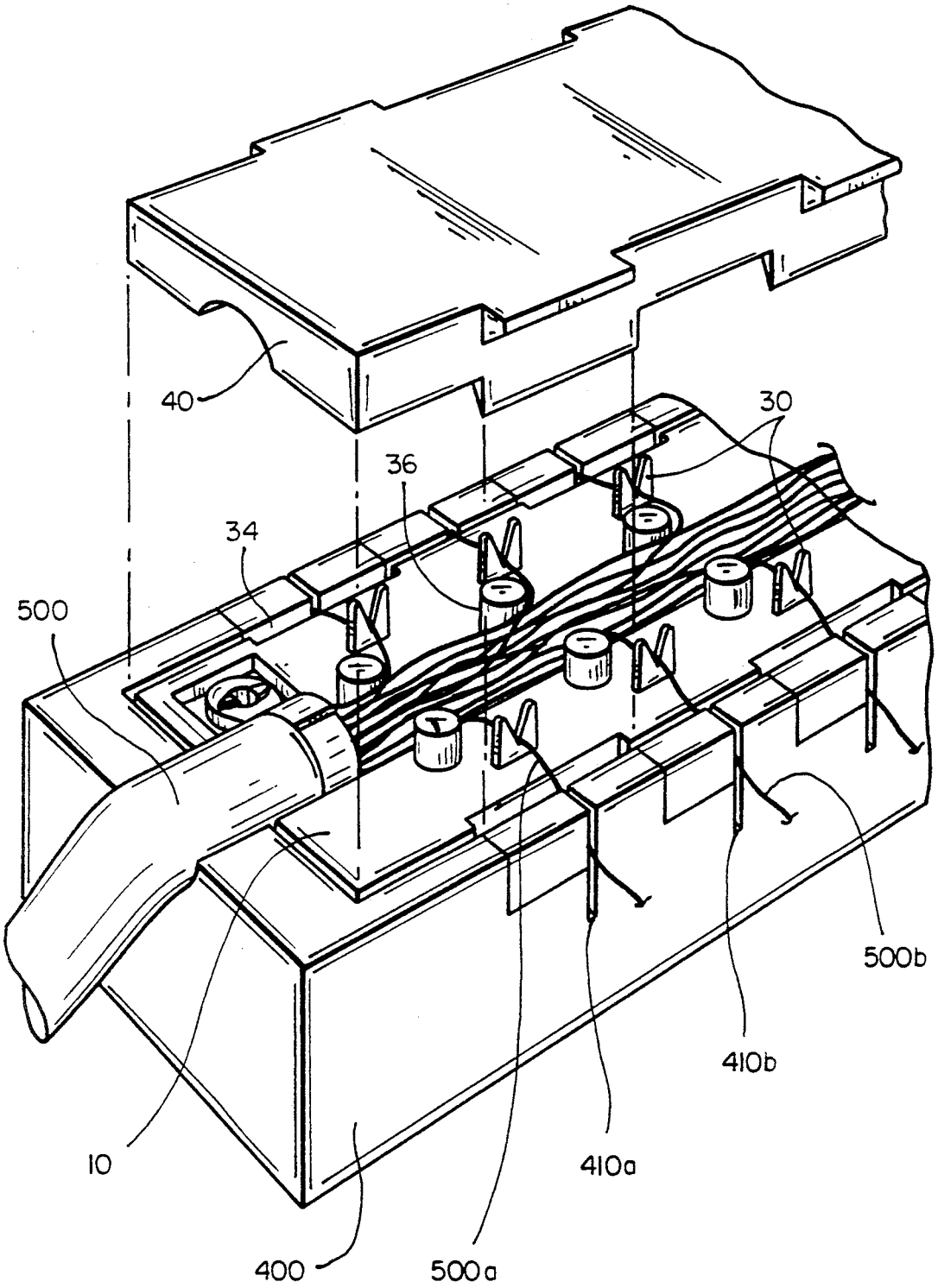
FIG. 7 illustrates the cable affixed and terminated within the back side of the block with at least one wire cut to size and the back cover for sealing thereto.

The cable 500 is connected into the back of the block by a screw bolt, rivet, or other suitable means and the wires 500*a*, 500*b*, etc., are passed over insulation displacement contacts (IDC) 30*a*, 30*b*, etc. and guided through a second test IDC 410*a*, 410*b*, and the like, in a test fixture 400 and across a suitable void 34 which can also double as a place for the cover to attach thereto. With the wires within the insulation displacement forks 410*a*, 410*b*, etc., they can be individually tested and, if appropriately connected, snipped off with a suitable cutting machine at the depression 34 (FIG. 6). Then a cover 40 (FIG. 7) containing a suitable sealing material such as a potting material or gel, grease, and the like, is snapped on. In further embodiments, the cover can terminate the extra tails of the wires 500*a*, 500*b*, etc., to automatically seal the block upon attachment of the back cover 40 to the block 10. In this embodiment all the wire tails are severed at once not just the individual wire tail, as illustrated in FIG. 7. This operation greatly streamlines the manufacturing of the block while providing a secure testing means which is less cumbersome than standard wire wrapping and testing procedures.

A particularly preferred embodiment for mating and demating within the terminal block 10 is illustrated in FIGS. 8 and 9. This embodiment is also suitable to protect any set of electrical contact(s) in a reversible fashion. The embodiment can be used in this block or any block. Although a suitable sealing material 202 and 204 is preferably a gel, the form of the apparatus permits the use of any suitable material such as grease and the like. More specifically, gel or grease filled elastomeric containers 200 and 210 contain mateable/demateable electrical contact(s) 212 and 214. The elastomeric containers, i.e., elastomeric bladders, 200 and 210 are filled with a gel or a grease, or other suitable sealing material. The greases can be selected synthetics or natural materials such as silicones, hydrocarbons, and the like. The gels are the previously recited materials.

Upon urging of the containers towards each other, the elastomeric materials of the containers expand outwards as illustrated in FIG. 9 which permit the contacts 212 and 214 to touch and the sealing material is maintained under compression there around. The compressive positive forces on the grease or gel inhibit the ingress of moisture. Upon disengagement of the units, the sealing material moves back to its prior shape thus shielding the contact 212 and 214. Thus the contacts 212/214 are sealed in both the connected and the unconnected state.

Figure 10:
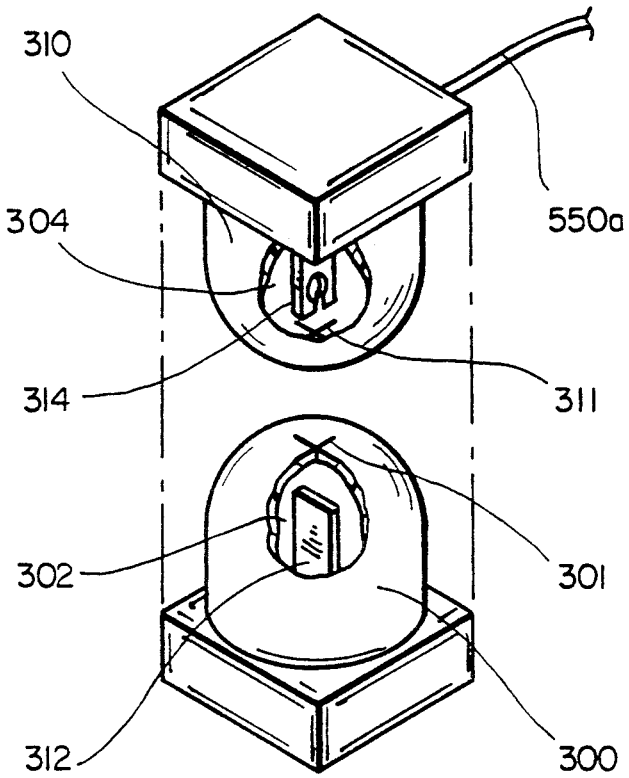
FIG. 10 illustrates an alternative embodiment of FIG. 8.
Figure 11:
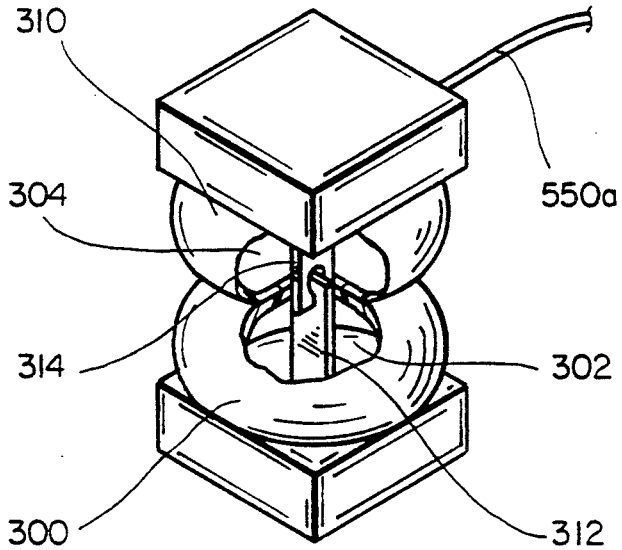
FIG. 11 illustrates an alternative embodiment of FIG. 9.

FIGS. 10 and 11 illustrate alternatively preferred embodiments of the invention wherein the electrical contact in the base unit is sealed within a substantially covered elastomeric member 300 containing the contact 312 and, preferably, filled with a gel material 302 and 304, respectively. As discussed previously, the preferred gel materials have a Voland hardness of from about 525 g to about 5 g and an ultimate elongation of at least 100% and preferably greater than 75% with a preferred temperature stability of the gel from about −40° to +140° F., and preferably −20° to +120° F. The module portion containing wires 550 has a mirror image sealed elastomeric membrane 310 containing a compatible gel or grease 304 and an insertion limiting contact 314. When urged together the closed aperture separates from the cross marks 301 and 311 illustrated in FIG. 10 to permit the contacts 312 and 314 to engage (FIG. 11). The aperture 301 and 311 can be a slit, cross or any shape that permits the contacts 312/314 to engage when urged together.

Of course, any combination of elastomeric members illustrated in FIGS. 8–11 can be employed, i.e., the base member can be covered or open and the drop wire or module member can be covered or open such that the combination can be covered-covered, open open, covered open, open covered for the block/module combination, respectively. Preferably, both the module and the block are configured as illustrated in FIGS. 10 and 11 because this keeps the contact away from the environment without permitting dirt to gather on the sealing material. Other alternative embodiments include an elastomeric member 200 or 300 in the block and a rigid walled module member or an elastomeric module and a rigid walled central position of the block. Of these embodiments, the rigid walled module and elastomeric member in the block is preferred. The important aspect is a combined configuration that maintains the sealing material, preferably a gel, under compression.

Figure 12:
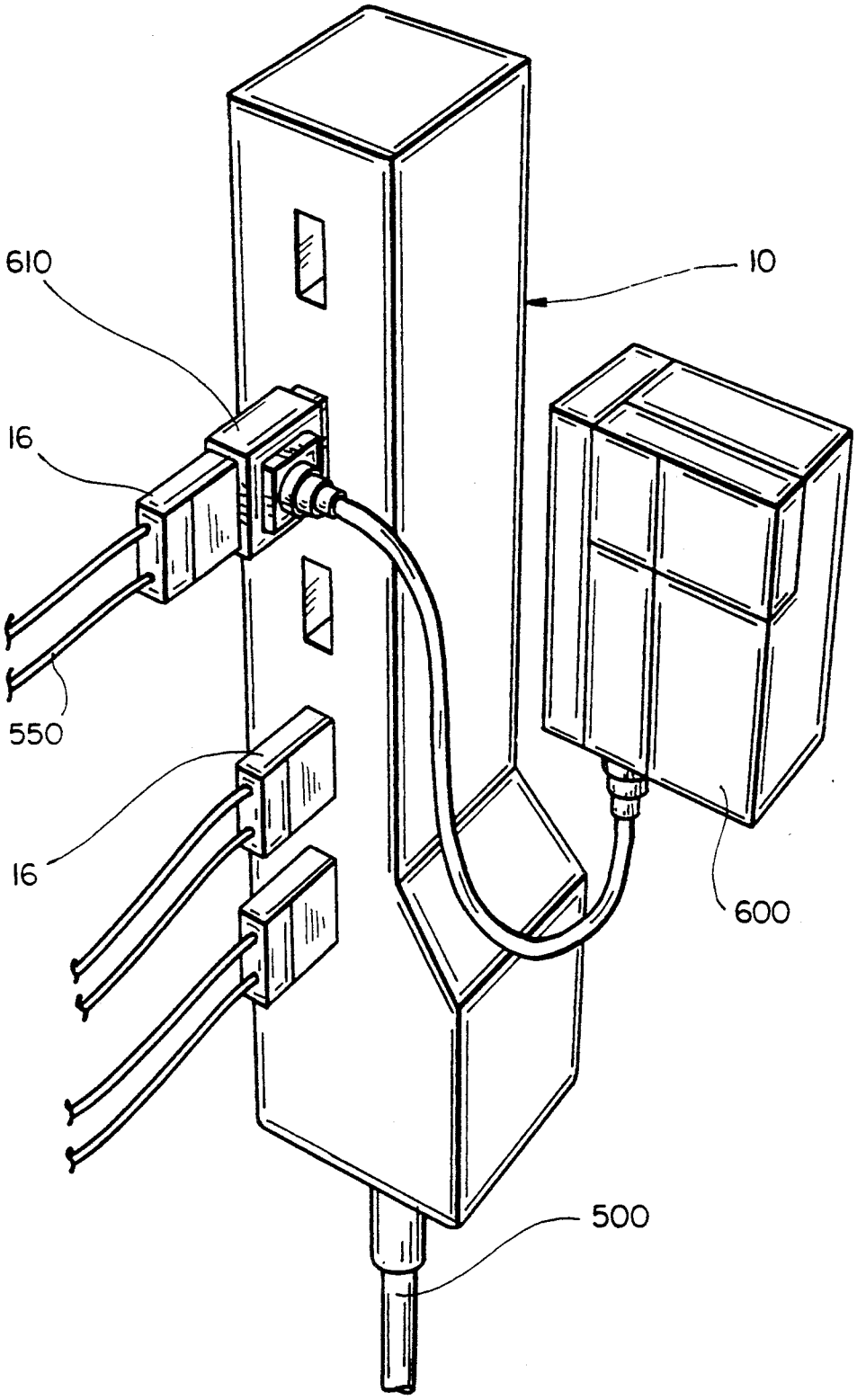
FIG. 12 illustrates an embodiment of the invention including a system test apparatus.

FIG. 12 illustrates a block of the invention with a mainline test feature attached thereto. More specifically, the test module 600 is plugged into the block 10 by insertable module 610. Whereupon the standard module 16 containing the drop wire 550 plugs into the test module 610.

Figure 13:
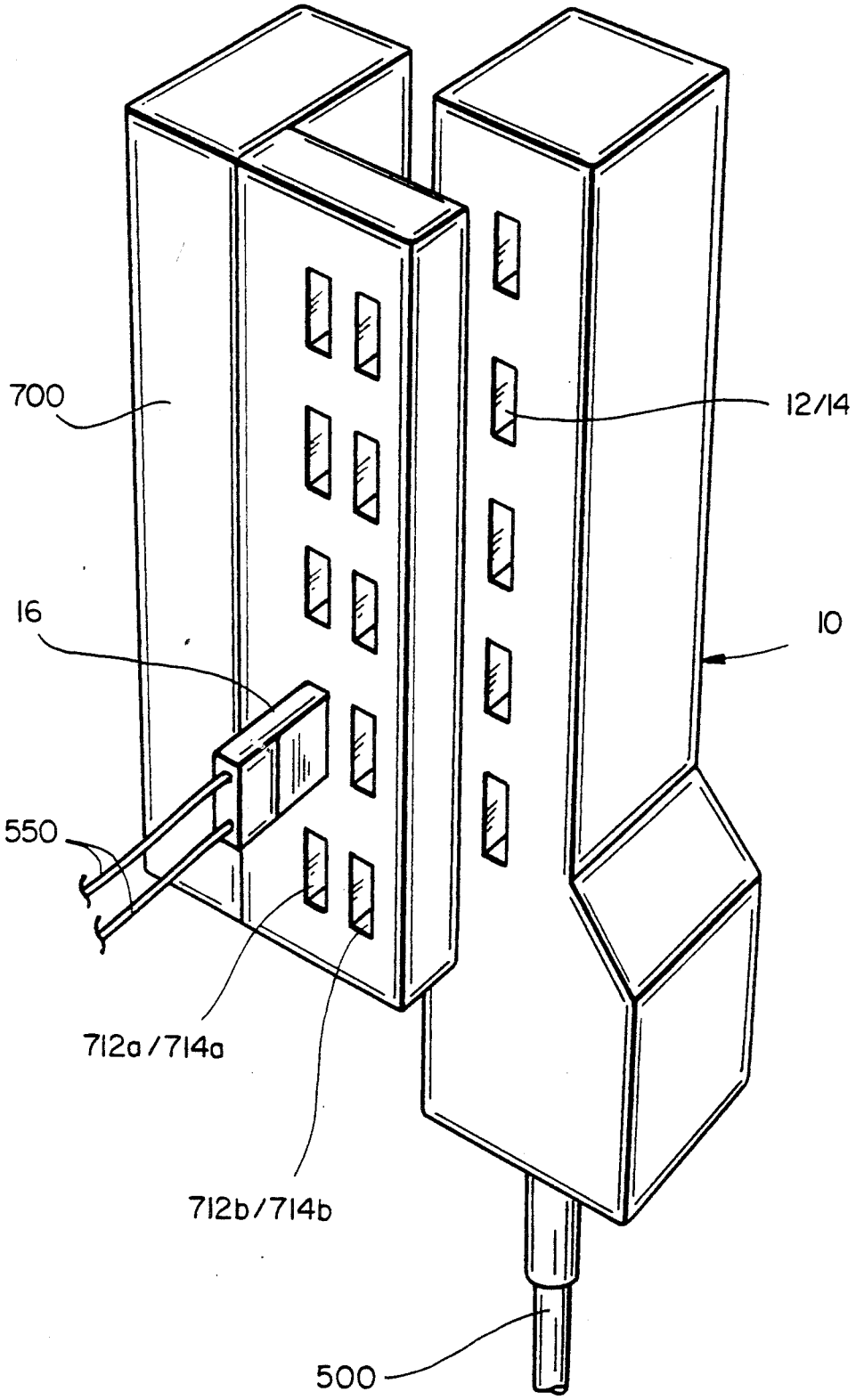
FIG. 13 illustrates a DAML module for insertion into the block of the invention.

FIG. 13 illustrates a block of the invention wherein a complete module is inserted into the block which provides circuit protection or a DAML 700 for the block. This embodiment illustrates block 10 connected to a device 700 containing either circuit protection which is fuses, i.e., gas tube or solid state, or a digitally added mainline (DAML) feature as illustrated by the two receptacles, 712*a*/714*a* and 712*b*/714*b*, for additional modules 16 within the DAML 700. Each receptacle 12/14 can receive a module-like connection within the block 10. The 712*a*/714*a*, 712*b*/714*b*, and 12/14 units are preferably configured like the items illustrated in FIG. 1. Optionally more than two receptacles can be utilized within the DAML 700.

Figure 14:
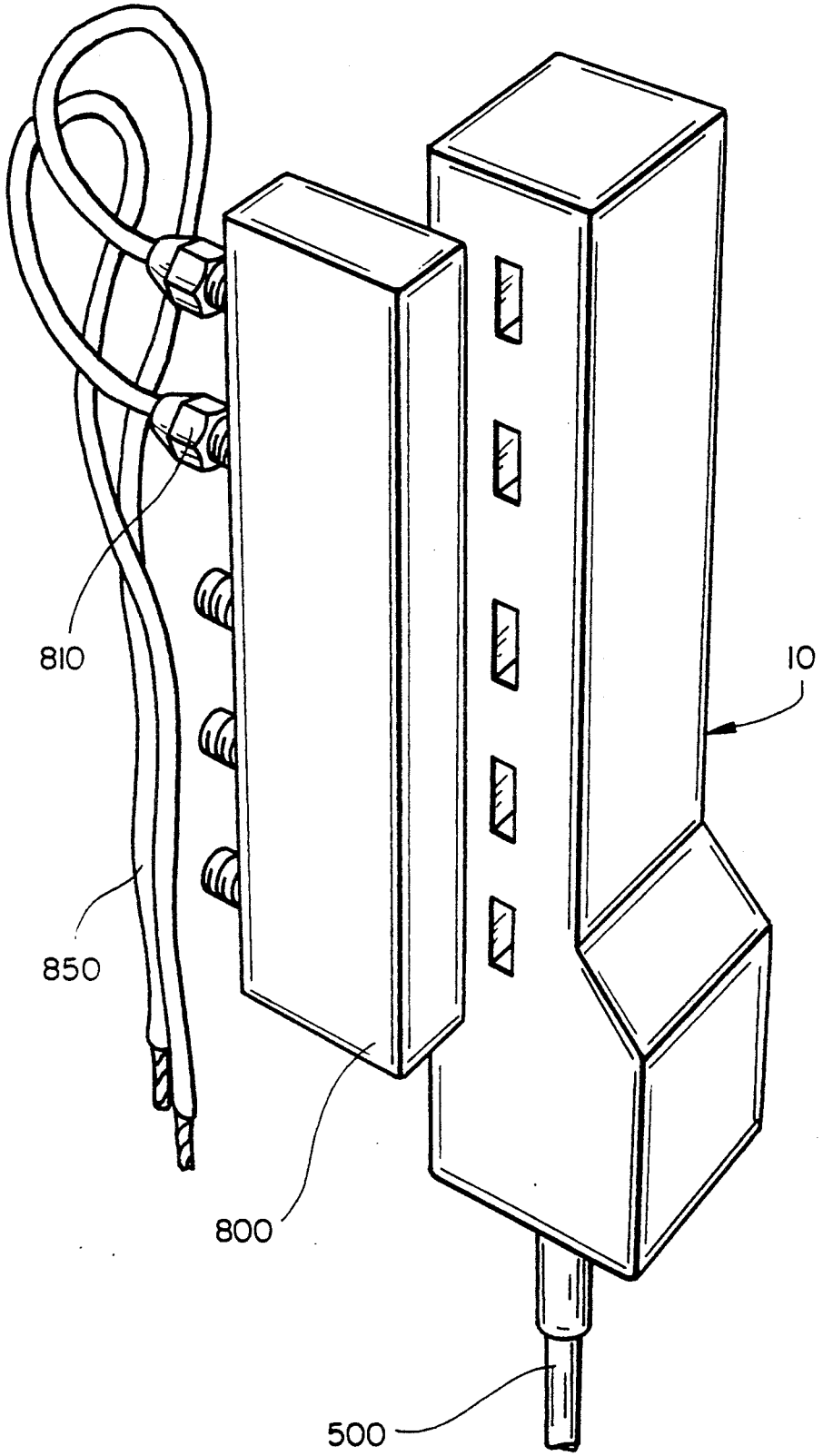
FIG. 14 illustrates a further embodiment utilizing coaxial cables terminated within a module for insertion into the modular block.

FIG. 14 illustrates the block according to the invention with a module sized to accept coaxial cables for future bandwidth expansion of carrier signal. In this embodiment, a unit 800 is connected to the block 10. The unit 800 connects to coaxial cable connectors 850 through connectors 810.

Figure 15:
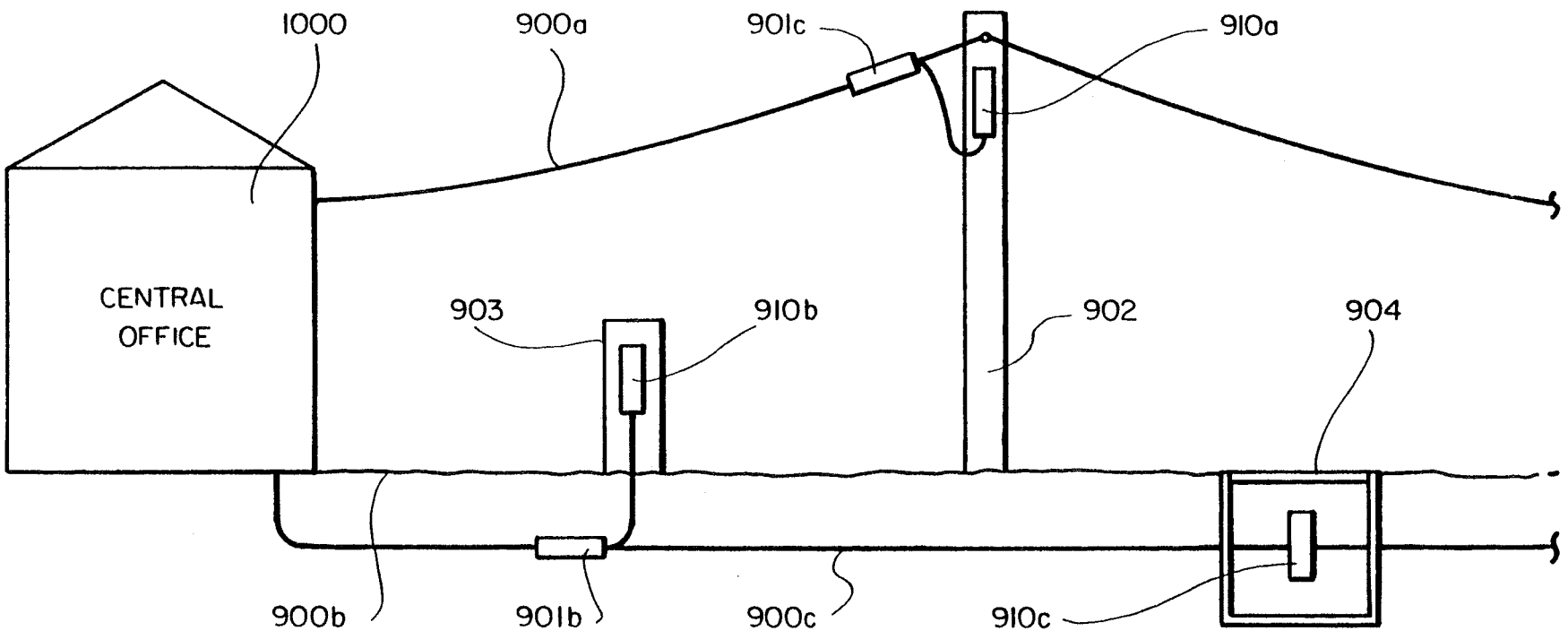
FIG. 15 illustrates a telephone system including a modular terminal embodiment of the invention.

FIG. 15 illustrates the telephone system including the terminal of the invention. A plurality of main cables 900*a* (aerial) or 900*b* (buried), or mixtures thereof, are connected to the central office 1000. At approximate places, splices 901*a*, 901*b*, and 901*c* are made in the main cable to splice into the terminal cable and the terminal 910*a*, 910*b*, and 910*c* contained in a telephone pole 902; a pedestal closure 903, or a hand hole 904, and the like. Individual subscribers are connected into the system through drop wires by the modules of the invention at the terminal blocks 910*a*, 910*b*, and 910*c*.

The invention has been described with reference to particular preferred embodiments. Modifications which are within the spirit and scope of the invention are contemplated to be within the scope of the invention. For example, the apparatus is not limited to the preferred embodiment of a sealed drop wire connector but can form any sealed electrical connection system.

We claim:

1. A method of manufacturing a telecommunications terminal block which comprises:

removing the jacket of a cable to expose the individual wires contained therein;

placing the exposed wires into the side of the telecommunications terminal block opposite to the side capable of forming a reversible contact with drop wires through an insertable drop wire module;

aligning individual wires with means for forming an electrical contact therewith;

forming an electrical contact between a wire and an electrical contact; and fixing a sealing cover over the wires and electrical contacts, said fixing step including cutting the wires to length greater than the length necessary for forming the electrical contact with the means for forming the electrical contact.

2. The method of manufacture according to claim 1 wherein the wires are tested for correct electrical wiring prior to attachment of the sealing cover and prior to cutting and making an insulation displacement connection thereto.

3. The method according to claim 2 wherein the individual wires are cut to size prior to attachment of the sealing cover.

4. The method according to claim 1 wherein the means for forming an electrical contact is an insulation displacement terminal.

5. The method according to claim 4 wherein the sealing cover contains a gel.

6. The method according to claim 5 wherein the sealing is achieved with a gel.

7. The method according to claim 5 wherein the gel has a Voland hardness of from about 525 g to about 5 g and an ultimate elongation of at least about 75%.

8. The method according to claim 5 wherein the gel has a Voland hardness of from about 380 g to about 10 g and an ultimate elongation of at least about 100%.

* * * * *